US006035869A

United States Patent [19]

Quebedeaux et al.

[11] Patent Number: 6,035,869

[45] Date of Patent: Mar. 14, 2000

[54] DISH-WASHING METHOD

[75] Inventors: Deborah A. Quebedeaux, Thibodaux; Joe D. Sauer, Baton Rouge; Conrad J. Langlois, Jr., New Roads; Patrick C. Hu, Baton Rouge, all of La.

[73] Assignee: Albemarle Corporation, Richmond, Va.

[21] Appl. No.: 09/182,749

[22] Filed: Oct. 29, 1998

Related U.S. Application Data

[63] Continuation-in-part of application No. 08/926,569, Sep. 10, 1997, abandoned.

[51] Int. Cl.[7] ..... B08B 3/08; C11D 1/75; C11D 17/00

[52] U.S. Cl. ..... 134/25.2; 134/42; 510/235; 510/237; 510/446; 510/503

[58] Field of Search ..... 134/25.2, 42; 510/235, 510/237, 224, 446, 503

[56] References Cited

U.S. PATENT DOCUMENTS

| | | | |
|---|---|---|---|
| 3,223,647 | 12/1965 | Drew et al. | 510/237 |
| 3,516,937 | 6/1970 | Story et al. | 510/439 |
| 5,075,501 | 12/1991 | Borland et al. | 564/297 |
| 5,085,892 | 2/1992 | Corona et al. | 427/365 |
| 5,358,655 | 10/1994 | Kruse et al. | 510/224 |
| 5,391,315 | 2/1995 | Ashkin | 510/235 |
| 5,397,506 | 3/1995 | Groth et al. | 510/365 |
| 5,498,373 | 3/1996 | Miller et al. | 510/535 |
| 5,583,258 | 12/1996 | Hawkins | 564/298 |

FOREIGN PATENT DOCUMENTS

| | | |
|---|---|---|
| 0421327 | 4/1991 | European Pat. Off. . |
| 2291067 | 1/1996 | United Kingdom . |
| 9505440 | 2/1995 | WIPO . |
| 9604362 | 2/1996 | WIPO . |
| 9632464 | 10/1996 | WIPO . |

*Primary Examiner*—Lorna M. Douyon
*Attorney, Agent, or Firm*—Philip M. Pippenger

[57] ABSTRACT

Dishes are cleaned by washing them with a cleaning implement which has been charged with the detergent in a solid block made from a formulation having a water-soluble alkali metal salt content of 15–60% by weight and a surfactant content of 10–70% by weight, said surfactant comprising 15–100% by weight of at least one amine oxide corresponding to the formula RR'R"NO $\cdot nH_2O$ in which R and R' are independently selected from methyl, ethyl, and 2-hydroxyethyl, R" is a primary alkyl group containing 12–16 carbons, and n represents 0, 1, or 2.

12 Claims, No Drawings

DISH-WASHING METHOD

CROSS-REFERENCE TO RELATED APPLICATION

This application is a continuation-in-part of application Ser. No. 08/926,569, filed Sep. 10, 1997, now abandoned.

FIELD OF INVENTION

The invention relates to the use of cleaning blocks in cleaning dishes.

BACKGROUND

As is well known, dishes are customarily cleaned by washing them with a liquid detergent and then rinsing them—usually under running water. There are two techniques by which the washing is accomplished. In some countries, e.g., the United States, the normal practice is to dilute the liquid detergent with water in a pan or sink and then wash the dishes in the diluted detergent. In other countries, e.g., Japan and other Asian nations, water is saved by simply applying concentrated liquid detergent to a suitable cleaning implement, such as a sponge or cloth, and washing the dishes with the thus-charged cleaning implement. The present invention provides an advantageous alternative to this Asian wash procedure.

SUMMARY OF INVENTION

It has now been found that satisfactory cleaning of dishes may be accomplished by washing them with a cleaning implement which has been charged with the detergent in a solid block made from a formulation having a water-soluble alkali metal salt content of 15–60% by weight and a surfactant content of 10–70% by weight, said surfactant comprising 15–100% by weight of at least one amine oxide corresponding to the formula $RR'R''NO \cdot nH_2O$ in which R and R' are independently selected from methyl, ethyl, and 2-hydroxyethyl, R" is a primary alkyl group containing 12–16 carbons, and n represents 0, 1, or 2.

In a preferred embodiment, the invention resides in the use of dish-cleaning blocks which have no ingredients other than the water-soluble alkali metal salt(s) and surfactant or which have as their only other ingredients up to 15% by weight of one or more oils, up to 20% by weight of one or more water-soluble dyes, up to 15% by weight of one or more antimicrobial agents, and up to 10% by weight of any additional adjuvants or fillers.

DETAILED DESCRIPTION

The amine oxides used in the practice of the invention may be any amine oxides corresponding to the above formula, e.g., N,N-dimethyldodecylamine oxide, N,N-dimethyltetradecylamine oxide, N,N imethylhexadecylamine oxide; the corresponding N,N-diethyl-, N,N-di-2-hydroxyethyl-, N-methyl-N-ethyl-, N-methyl-N-2-hydroxyethyl-, and N-ethyl-N-2-hydroxyethylalkyl amine oxides; and the corresponding amine oxide monohydrates and dihydrates. However, because of the ease with which they can be obtained in solid form, it is generally preferred that they be amine oxides in which at least some of the molecules are dihydrate molecules, i.e., the appropriate amine oxides described and claimed in U.S. Pat. No. 5,075,501 (Borland et al.), the teachings of which are incorporated herein by reference. Such amine oxides are commercially available from Albemarle Corporation under the tradename ADMOX®.

The surfactant may have no ingredients other than the essential amine oxide(s). However, as already indicated, the desired results can also be achieved when the surfactant contains up to 85% by weight of surfactants other than these amine oxides, including, e.g., amine oxides corresponding to the above formula except for having more than 16 carbons, e.g., 18–24 carbons, in the primary alkyl group. When such other surfactants are employed, they may be any anionic, cationic, nonionic, amphoteric, or zwitterionic surfactants which have melting points high enough to permit processing (usually higher than 43° C., preferably higher than 50° C.) or lower-melting surfactants that are present in amounts too small to interfere with processing.

Exemplary of these optional components of the surfactant are the cationics known to be useful for their germicidal properties; salts of alkylbenzene sulfonates, alkyl sulfates, and olefin sulfates and sulfonates; alkoxylated fatty alcohols and alkylphenols; ethoxylated amines and amides; and other such surfactants. Of these surfactants, the anionics are usually preferred—especially the anionic α-olefin sulfonates, such as the sodium salt of the sulfonate obtained from a mixture of $C_{14}$ and $C_{16}$ α-olefins.

The water-soluble alkali metal salt ingredient of the dish-cleaning blocks functions inter alia to enhance the cleaning power and increase the specific gravity of the blocks. It may be a single non-surfactant salt or a mixture of salts that are preferably neutral or only mildly acidic or alkaline, e.g., alkali metal carbonates, bicarbonates, sulfates, citrates, and phosphates. Although other alkali metal salts may be used, the sodium salts are preferred; and it is also generally preferred for at least 30%, more preferably at least 40%, of the weight of the salts to be provided by sodium citrate. Phosphates, when employed, should constitute not more than 10% of the weight of the blocks. In preparing the cleaning blocks of the invention, the amount of this ingredient utilized is such that the blocks have a water-soluble alkali metal salt content of 15–60%, preferably 20–55% by weight.

If desired, the aforementioned essential ingredients may be combined with certain other ingredients before being shaped into cleaning blocks, although the amounts of additional ingredients employed should be such that the essential ingredients constitute at least 50% of the weight of the cleaning blocks.

Among the optional ingredients apt to be desired in the preparation of the cleaning blocks are organic oils, which are beneficial in facilitating homogeneous blending of the constituents and, when perfumes, can also function as fragrances. Utilizable oils include, e.g., glycerin, low molecular weight polyethylene glycols, paraffinic and naphthenic hydrocarbons, and oily perfumes such as pine oil, eugenol, limonene, methyl salicylate, ethyl salicylate, and ethyl succinate. When employed, the oil component may be a single oil or a mixture of oils used in an amount such that the oil content of the cleaning block does not exceed 15% by weight and is usually in the range of 1–15% by weight.

It is also permissible to include one or more water-soluble dyes in the cleaning blocks to impart a desired color—the amount included being such that the dye content of a block is not more than 20% by weight. When such dyes are used, they may be any of the dyes commonly used to impart the colors which might be most appealing to users of the blocks, e.g., colors commonly associated with dishwashing detergents or colors that would harmonize with the colors in the kitchens in which the blocks will be used.

When the cleaning blocks are intended to have a disinfecting function, they also contain up to 15% by weight of one or more antimicrobials, such as those conventionally used in toilet cleaners, e.g., Dowcil® 75, a product of Dow Chemical Company.

Other utilizable ingredients are additional adjuvants (e.g., the builders, chelating agents, sequestering agents,buffers, enzymes, bleaches, and bleach activators that have been found useful in known toilet-cleaning blocks) and fillers (such as sodium borate, magnesium chloride, magnesium sulfate, and high molecular weight polyethylene glycols and polypropylene glycols) which provide additional bulk and may enhance leaching out of the surfactant onto the cleaning implement used to clean dishes. When employed, the combined weights of these additional adjuvants and fillers should be such that they constitute not more than 10% of the weight of the cleaning block.

The cleaning blocks of the invention are prepared by homogeneously mixing the desired ingredients in the proper amounts and shaping the resultant mixture into blocks having the desired size and shape. Although the blocks may have any size and shape (e.g., cylindrical, oval, round, or rectangular) that suit the manufacturer and consumer, and they include, e.g., cylinders having a weight of 30–100 grams, a length of 1.2–5.2 cm, and a diameter of 2.5–7.6 cm or rectangular blocks having an essentially corresponding or larger size, they are preferably blocks large enough to have a reasonably long life, e.g., blocks having a weight of 40–140 grams. Except for the use of the particular ingredients required for the preparation of the novel blocks, the mixing and shaping can be effected by any of the conventional techniques already employed in the preparation of toilet-cleaning blocks, e.g., the techniques taught in U.S. Pat. No. 4,722,802 (Hutchings et al.).

The invention is advantageous in that it provides cleaning blocks which permit the use of the aforementioned Asian dish-washing procedure without requiring the implementation of concentrated liquid detergent which must be squeezed onto a suitable cleaning implement from a detergent bottle. When the cleaning blocks of the invention are used in this procedure, they may be kept near the sink at which they will be employed, e.g., in a conventional soap dish or in a container attached to the wall or window sill, and utilized by (1) dampening a sponge, cloth, or other suitable cleaning implement with water, (2) charging the dampened cleaning implement with detergent by rubbing it with the cleaning block, and (3) wiping the dirty dishes with the thus-charged cleaning implement The following examples are given to illustrate the invention and are not intended as a limitation thereof. Unless otherwise specified, quantities mentioned in these examples are quantities by weight. Codes used in the examples have the meanings given below.

| Code | Definition |
|---|---|
| AX-1485 | N,N-dimethyltetradecylamine oxide dihydrate, prepared essentially as in Borland et al. |
| AX-1685 | N,N-dimethylhexadecylamine oxide dihydrate, prepared essentially as in Borland et al. |
| AX-1885 | N,N-dimethyloctadecylamine oxide dihydrate, prepared essentially as in Borland et al. |
| AS-1416 | sodium salt of a mixture of $C_{14}$ and $C_{16}$ alkyl sulfates |
| AOS-1416 | sodium salt of sulfonate obtained from a mixture of $C_{14}$ and $C_{16}$ α-olefins |
| CocoMEA | cocomonoethanolamide |

EXAMPLES 1–6

Prepare a series of cleaning bars by homogeneously blending the ingredients in a Kitchen Aid blender and then in a Plodder mixer, extruding the blend at 50–55° C., cutting the extrudate, shaping the cut extrudate into bars in a mold, and allowing the bars to set up for at least one hour. Then test each of the bars by (1) dampening a cleaning cloth with water, (2) rubbing the dampened cloth against the bar to charge it with the detergent in the bar, (3) wiping dirty dishes with the thus-charged cloth, (4) rinsing the wiped dishes with running water, and (5) noting the cleaning effectiveness of the bars in grease cutting and general hard surface cleaning, as well as their mildness to the slin and the amount of foam they produce. Also measure the slough rates of the bars to determine if the bar characteristics are poor (slough rate >20%), good (slough rate <10%), or very good (slough rate <5%). The ingredients used in preparing the different bars and the test results are shown in the Table below.

TABLE

| | Example | | | | | |
|---|---|---|---|---|---|---|
| | 1 | 2 | 3 | 4 | 5 | 6 |
| AX-1485 | 15.0 | — | — | 7.5 | 7.5 | 15.0 |
| AX-1685 | — | 15.0 | — | 7.5 | — | — |
| AX-1885 | — | — | 15.0 | — | 7.5 | — |
| AOS-1416 | 35.0 | 35.0 | 35.0 | 35.0 | 35.0 | 20.0 |
| AS-1416 | — | — | — | — | — | 15.0 |
| CocoMEA | 20.0 | 20.0 | 20.0 | 20.0 | 20.0 | 20.0 |
| Na citrate | 15.0 | 15.0 | 15.0 | 15.0 | 15.0 | 15.0 |
| $Na_2SO_4$ | 14.85 | 14.85 | 14.85 | 14.85 | 14.85 | 14.85 |
| Fragrance (lemon) | 0.1 | 0.1 | 0.1 | 0.1 | 0.1 | 0.1 |
| Yellow DC10 dye | 0.05 | 0.05 | 0.05 | 0.05 | 0.05 | 0.05 |
| General cleaning | good | good | poor | good | good | poor |
| Grease cutting | good | good | poor | good | good | poor |
| Skin mildness | good | good | good | good | good | good |
| Foam | good | fair | poor | good | good | good |
| Slough rate | <10% | <5% | <5% | <5% | <5% | >20% |

What is claimed is:

1. A dish-washing method which comprises (1) dampening a cleaning implement with water, (2) rubbing the dampened cleaning implement against a surfactant-containing dish-cleaning block to charge it with the surfactant in the block, and (3) wiping at least one dirty dish with the thus-charged cleaning implement; said dish-cleaning block being a block which has a water-soluble alkali metal salt content of 15–60% by weight and a surfactant content of 10–70% by weight, said surfactant comprising 15–100% by weight of at least one amine oxide corresponding to the formula $RR'R''NO \cdot nH_2O$ in which R and R' are independently selected from the group consisting of methyl, ethyl, and 2-hydroxyethyl, R" is a primary alkyl group containing 12–16 carbons, and n represents, 1 or 2.

2. The dish-washing method of claim 1 wherein at least some of the amine oxide molecules are dihydrate molecules.

3. The dish-washing method of claim 2 wherein the amine oxide comprises N,N-dimethyltetradecylamine oxide dihydrate.

4. The dish-washing method of claim 2 wherein the amine oxide comprises N,N-dimethylhexadecylamine oxide dihydrate.

5. The dish-washing method of claim 1 wherein the surfactant also comprises up to 85% by weight of one or more cosurfactants selected from the group consisting of anionic surfactants and amine oxides corresponding to the formula $RR'R'''NO \cdot nH_2O$ in which R and R' are independently selected from the group consisting of methyl, ethyl, and 2-hydroxyethyl, R'" is a primary alkyl group containing 18–24 carbons, and n represents 0, 1, or 2.

6. The dish-washing method of claim 5 wherein the cosurfactant is N,N-dimethyloctadecylamine oxide, an anionic α-olefin sulfonate, or a mixture thereof.

7. The dish-washing method of claim 1 wherein the dish-cleaning block consists of:

(A) 15–60% by weight of one or more water-soluble alkali metal salts, (B) 10–70% by weight of a surfactant which is composed of (1) 15–100% by weight of at least one amine oxide corresponding to the formula RR'R"NO $\cdot nH_2O$ in which R and R' are independently selected from the group consisting of methyl, ethyl, and 2-hydroxyethyl, R" is a primary alkyl group containing 12–16 carbons, and n represents 1 or 2 and (2) up to 85% by weight of one or more cosurfactants selected from the group consisting of anionic surfactants and amine oxides corresponding to the formula RR'R"NO $.nH_2O$ in which R and R' are independently selected from the group consisting of methyl, ethyl, and 2-hydroxyethyl, R'" is a primary alkyl group containing 18–24 carbons, and n represents 0, 1, or 2, (C) 0–15% by weight of one or more oils, (D) 0–20% by weight of one or more water-soluble dyes, (E) 0–15% by weight of one or more antimicrobial agents, and (F) 0–10% by weight of one or more additional adjuvants or fillers, wherein the adjuvants are selected from the group consisting of builders, chelating agents, sequestering agents, buffers, enzymes, bleaches and bleach activators.

8. The dish-washing method of claim 7 wherein at least some of the amine oxide molecules of component (B)(1)are dihydrate molecules.

9. The dish-washing method of claim 7 wherein at least some of the amine oxide molecules of component (B)(1) are N,N-dimethyltetradecylamine oxide dihydrate.

10. The dish-washing method of claim 7 wherein at least some of the amine oxide molecules of component (B)(1) are N,N-dimethylhexadecylamine oxide dihydrate.

11. The dish-washing method of claim 7 wherein the cosurfactant is N,N-dimethyloctadecylamine oxide, an anionic α-olefin sulfonate, or a mixture thereof.

12. The dish-washing method of claim 1 wherein the dish-cleaning block has a weight of 40–140 grams.

* * * * *